US006561775B1

(12) United States Patent
Wefers

(10) Patent No.: US 6,561,775 B1
(45) Date of Patent: May 13, 2003

(54) IN SITU SEPARABLE ELECTRIC SUBMERSIBLE PUMP ASSEMBLY WITH LATCH DEVICE

(75) Inventor: Hans Wefers, Jever (DE)

(73) Assignee: Wood Group ESP, Inc., Oklahoma City, OK (US)

( * ) Notice: Subject to any disclaimer, the term of this patent is extended or adjusted under 35 U.S.C. 154(b) by 72 days.

(21) Appl. No.: 09/951,531

(22) Filed: Sep. 13, 2001

Related U.S. Application Data

(60) Provisional application No. 60/292,724, filed on May 21, 2001.

(51) Int. Cl.[7] ..... F04B 17/00; F04B 35/04

(52) U.S. Cl. ..... 417/423.3; 166/242

(58) Field of Search ..... 417/423.3, 360, 417/397; 166/369, 105, 242; 165/265; 29/890.14; 439/576

(56) References Cited

U.S. PATENT DOCUMENTS 4,295,801 A * 10/1981 Bennett ..... 417/397
4,901,413 A * 2/1990 Cotherman et al. ..... 29/890.14
5,156,206 A * 10/1992 Cox ..... 166/242
5,501,580 A 3/1996 Barrus et al.
5,722,820 A 3/1998 Wild et al.
5,954,483 A * 9/1999 Tetzlaff ..... 417/360
5,992,517 A * 11/1999 McAnally ..... 166/105
6,063,001 A 5/2000 Suhling et al.
6,089,832 A * 7/2000 Patterson ..... 417/360
6,138,758 A * 10/2000 Shaw et al. ..... 165/265
6,398,583 B1 * 6/2002 Zehren ..... 439/576
6,454,010 B1 * 9/2002 Thomas et al. ..... 166/369
6,468,058 B1 * 10/2002 Breit et al. ..... 417/423.3

FOREIGN PATENT DOCUMENTS

DE 197 15 278 A 1 3/1998

* cited by examiner

*Primary Examiner*—Teresa Walberg
*Assistant Examiner*—Leonid Fastovsky
(74) *Attorney, Agent, or Firm*—Crowe & Dunlevy, P.C.

(57) ABSTRACT

The present invention provides an electric submersible pump assembly with a latch device permitting downhole connecting and disconnecting of the pump and motor. The latch device includes a pump latch connector and a motor latch connector that allows a pump and an electric submersible motor to be disposed in a wellbore independently and then connected. The pump latch connector attaches to the pump and includes a rotor connector box and a stator connector pin. The motor latch connector attaches to the motor and includes a rotor connector pin and a stator connector box. The rotor connector pin is disposable in the rotor connector box and the stator connector pin is disposable in the stator connector box thus connecting the previously suspended motor and motor latch connector to a retrievable pump, with the pump latch connector attached.

18 Claims, 5 Drawing Sheets

IN SITU SEPARABLE ELECTRIC SUBMERSIBLE PUMP ASSEMBLY WITH LATCH DEVICE

RELATED APPLICATIONS

This application claims priority to Provisional Application Ser. No. 60/292,724 entitled "Electric Submersible Motor and Progressive Cavity Pump Assembly" filed May 21, 2001.

FIELD OF INVENTION

The present invention relates to the field of submersible pump assemblies, and more particularly but not by way of limitation, to an in situ separable electric submersible pump assembly with a latch device.

BACKGROUND OF THE INVENTION

In oil wells and the like from which the production of fluids is desired, a variety of fluid lifting systems have been used to pump the fluids to surface holding and processing facilities. It is common to employ various types of downhole pumping systems to pump the subterranean formation fluids to surface collection equipment for transport to processing locations.

One such prior art pumping system is a submersible pumping assembly which is supported immersed in the fluids in the wellbore. The submersible pumping assembly has a pump and motor to pressurize and pass the reservoir fluids through production tubing to a surface location.

In straight and deviated wells, equipped with seven inch or larger casing, the installation of a submersible pump is known. An existing electric submersible motor—progressive cavity pump installation, by way of example, may consist of the following installation sequence from the bottom of the well to the surface: an electric submersible motor pressure sensing device; an electric submersible motor; an electric submersible motor seal section; a motor gear section; a motor service section which attaches to the stator adapter and a left-hand threaded rotor adapter of the pump with an outside diameter of a three and one half inches. The pump can be attached to a two and seven eighth inch outside diameter EUE tubing and to a tubing adapter with an optional check and bleeder valve. A flat motor cable is also attached to the motor and is spliced to a power cable that runs to the surface along with the tubing. After the tubing is landed and the well sealed off from the surface, the motor cable is connected to a switchboard or variable speed converter and the motor is energized so that the pump will operate as required.

The typical electric submersible pump assembly that includes a submersible pump, an electric motor and a connection interdisposed between the pump and the motor uses the connection to allow the pump and motor to be placed in the hole and be removed from the well without separating. Prior art connections have not proved effective in preventing fishing jobs or time consuming workover jobs. Currently the whole electric submersible pump assembly must be pulled out of the hole and run back in whenever a pump failure occurs, such as when a stator or rotor must be changed.

There is a need in the industry for an electric submersible pump assembly that will allow the pump rotor or stator to be changed without pulling the motor. Such a system would decrease costs and time associated with workovers.

SUMMARY OF THE INVENTION

The present invention provides an electric submersible pump assembly with a latch device that includes a pump latch connector and motor latch connector that allows a pump and an electric submersible motor to be placed in the wellbore independently and then connected. The pump latch connector attaches to the pump and includes a rotor connector box and a stator connector pin. The motor latch connector attaches to the motor and includes a rotor connector pin and a stator connector box. The rotor connector pin is disposable in the rotor connector box and the stator connector pin is disposable in the stator connector box thus connecting the previously suspended motor and motor latch connector to the retrievable pump and attached pump latch connector.

The advantages, benefits and features of the present invention will become clear from the following detailed description and drawings when read in conjunction with the appended claims.

DESCRIPTION

Figure 1:
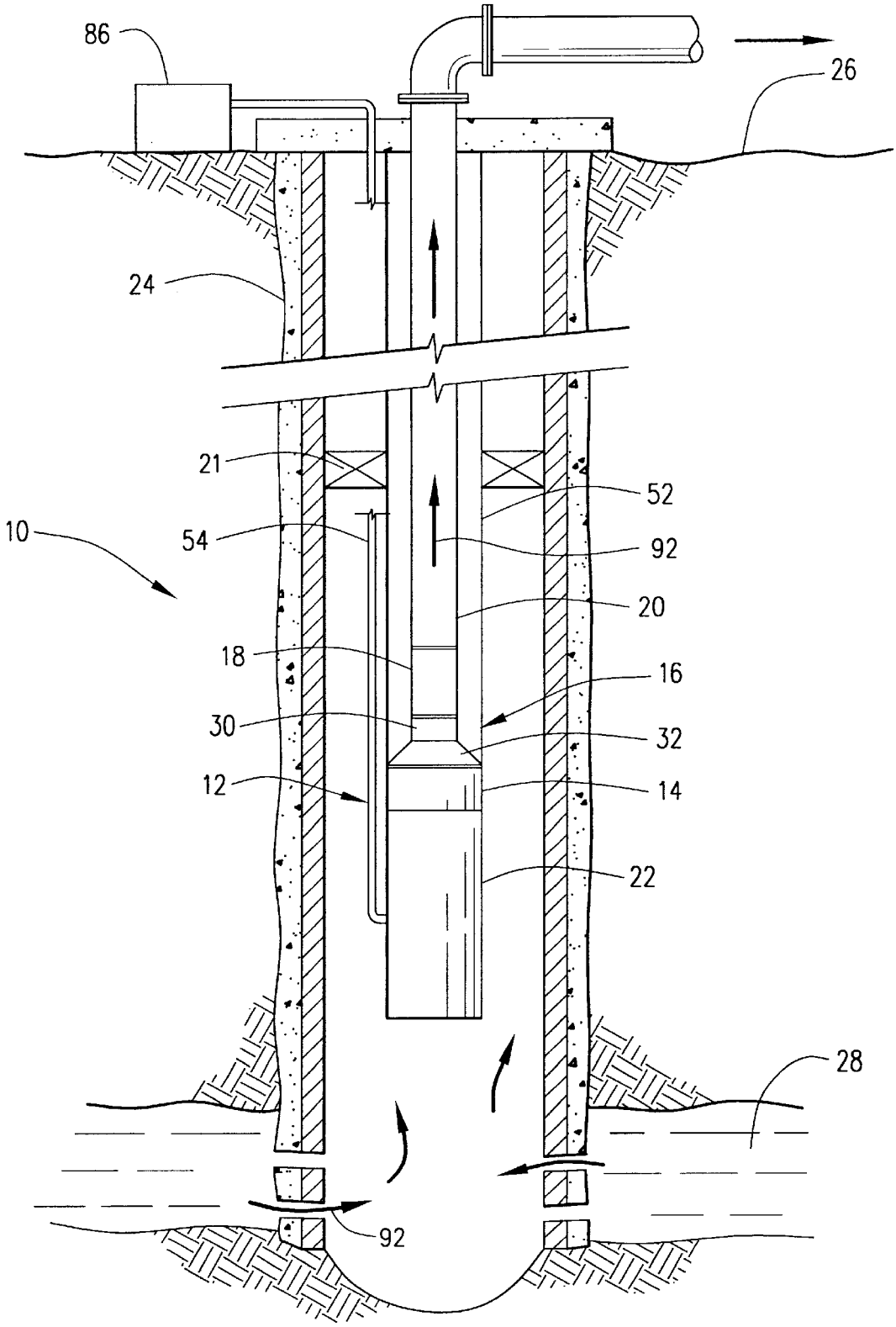
FIG. 1 is a semi-diagrammatical, elevational view of an electric submersible pump assembly constructed in accordance with the present invention.

Referring to the drawings, and more particularly to FIG. 1, shown therein is an electric submersible pump assembly 10, sometimes also referred to as an ESP assembly. The electric submersible pump assembly 10 has, as arranged from bottom to top, a motor assembly 12 including a motor service section 14, a latch device 16, a pump 18, production tubing 20, and a packer 21. The motor assembly 12 has an electric submersible motor 22 with possible attachments, such as a seal section, gear section and sensing devices that are well known by those skilled in the art. The electric submersible pump assembly 10 is placed in a wellbore 24 below ground level or surface 26 and extending through a reservoir, also known as the production zone 28. The latch device 16 includes a pump latch connector 30 and a motor latch connector 32.

Figure 2:
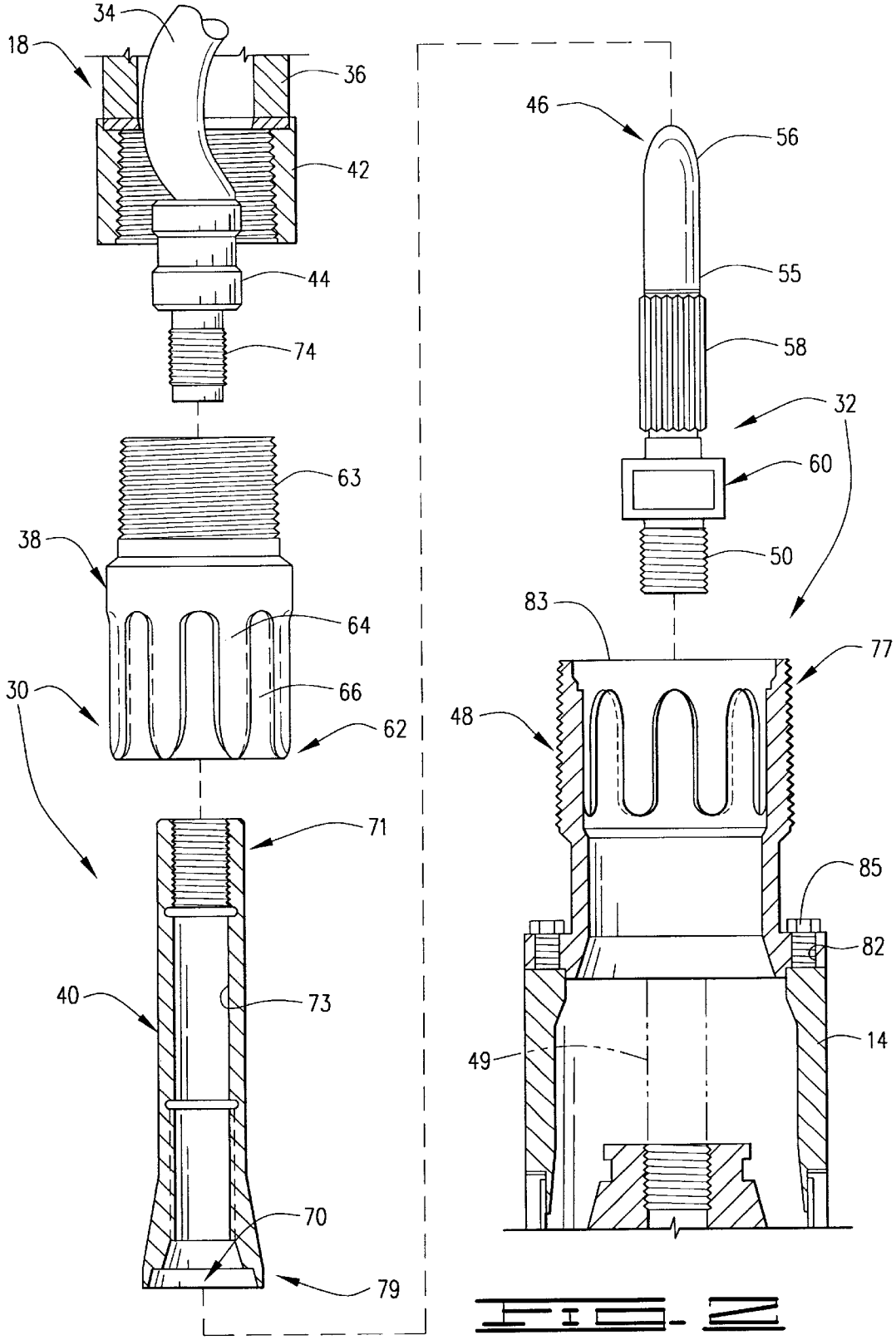
FIG. 2 is an elevational view of latch device components of the electric submersible pump assembly of FIG. 1.

FIG. 2 shows the pump latch connector 30 of the latch device 16 connected to a rotor 34 and a stator 36 of the pump 18. The pump latch connector 30 includes a stator connector pin 38 and a rotor connector box 40. A stator coupling 42, with internal right-hand box threads, attaches the stator connector pin 38 to the stator 36. A rotor coupling 44, with left-hand threads, attaches the rotor connector box 40 to the rotor 34.

FIG. 2 also shows the motor latch connector 32 which includes a rotor connector pin 46 and a stator connector box 48. The motor service section 14 is bolted to the stator connector box 48. The rotor connector pin 46 attaches to the motor shaft 49 of the motor service section 14 with left-hand threads 50. The pump latch connector 32 can be placed in the wellbore, with the motor assembly 12 using motor tubing 52 that can be non-upset (EUE) motor tubing 52, and a tubing collar, not separately designated in FIG. 1 wherein is shown a power cable 54 attached to the motor tubing 52.

Figure 3:
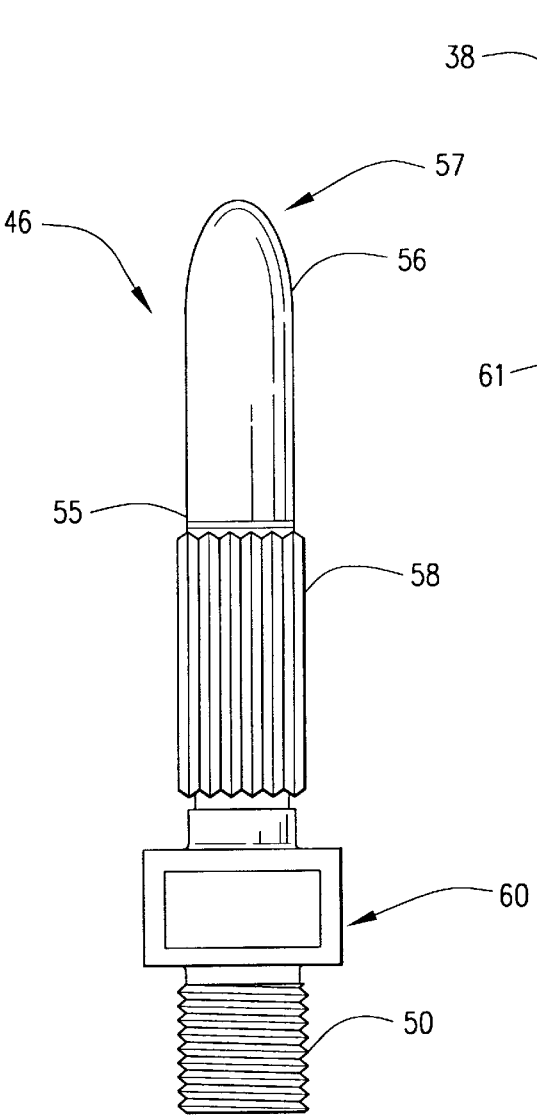
FIG. 3 is an elevational view of a rotor connector pin of the electric submersible pump assembly of FIG. 1.

FIG. 3 shows the rotor connector pin 46 having a device body 55 which includes a guide pin 56 on an upper end portion 57, an easy-catch hex, involute spline member 58, a lower end portion 60, which can include a base which includes the external threads 50. The easy-catch hex, involute spline member 58 is an engaging member that can be a locking means as well as a locating means. The rotor connector pin 46 screws into the motor shaft 49 of the motor service section 14 via the threads 50.

Figure 4A:
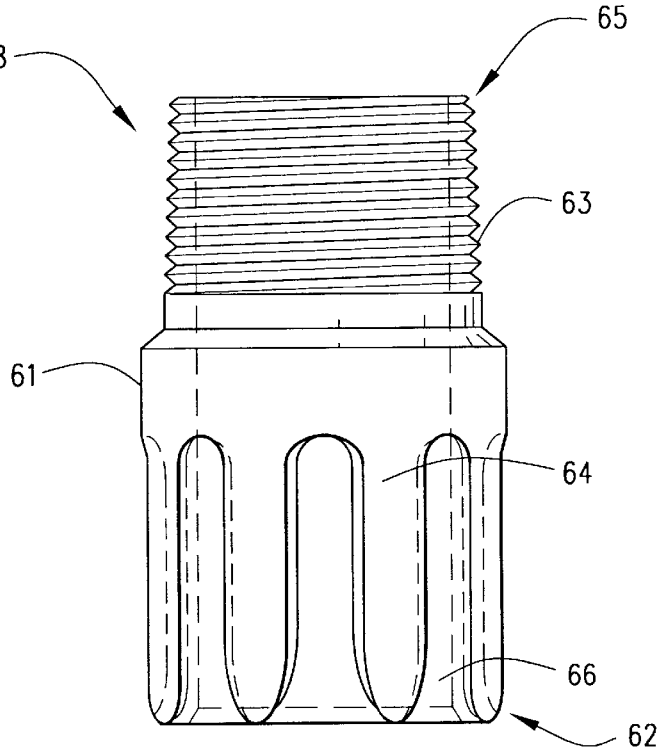
FIG. 4A is an elevational view of a stator connector pin of the electric submersible pump assembly of FIG. 1.

FIG. 4A shows the stator connector pin 38 which has a device body 61 with a lower end portion 62, external right-hand threads 63, male easy-catch, hex spline members 64, an upper end portion 65, and grooves 66. The device body 61 of the stator connector pin 38 defines a central cavity that is concentric on the longitudinal axis of the stator connector pin 38. The male easy-catch, hex spline members 64, that are engaging members, can be a locking means as well as a locating means. The stator connector pin 38 is joined to the stator coupling 42 via the threads 63 (see FIG. 2). Of course, the stator connector pin 38 could be connected in alternate ways, such as with a pin or by welding.

Figure 4B:
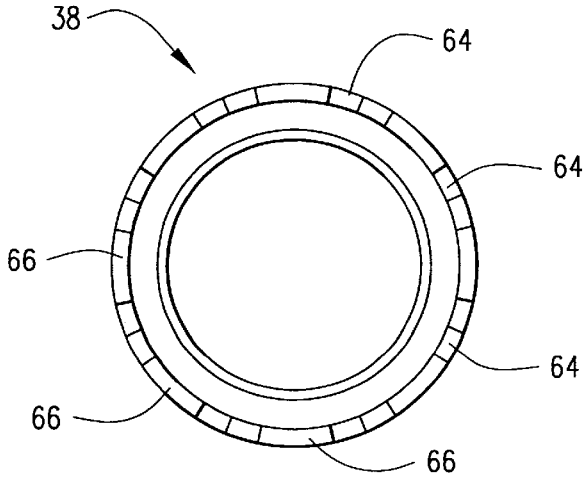
FIG. 4B is a projected end view of a stator connector pin of.the electric submersible pump assembly of FIG. 1.

FIG. 4B shows the projected end view of the stator connector pin 38 with the threads 63 that connect with the box threads of the stator coupling 42 shown in FIG. 2. The male easy-catch, hex spline members 64 and grooves 66 that interconnect with the stator connector box 48 are also shown.

Figure 5:
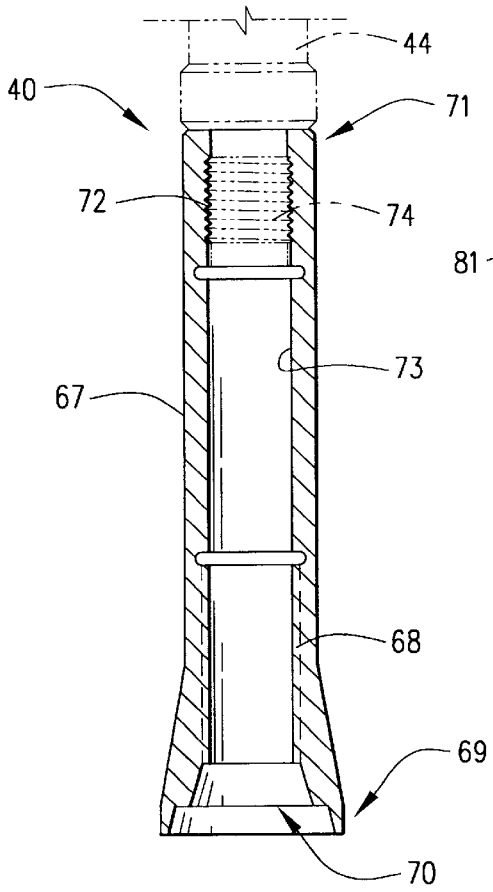
FIG. 5 is a partial cross-section elevational view of a rotor connector box of the electric submersible pump assembly of FIG. 1.
Figure 4:
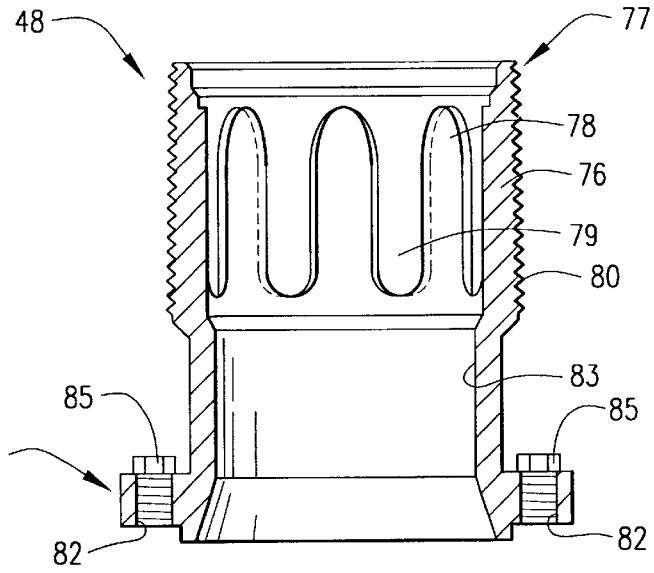

FIG. 5 shows the device body 67 of the rotor connector box 40 with an involute female spline member 68, a lower end portion 69, a guide-shoe 70, an upper end portion 71 and left-hand internal threads 72. The involute female spline member 68, which is an engaging member, can be a locking means as well as a locating means. The device body 67 of the rotor connector box 40 defines a central cavity 73 concentric thereto on the longitudinal axis of the rotor connector box 40. The dimensions of the cavity 73 are determined to accept the rotor connector guide pin 56 (FIG. 2). FIG. 5 also shows the position of the rotor coupling 44, with left-hand external threads 74, as attached to the rotor connector box 40. The threads 72, 74 connecting the rotor coupling 44 and the rotor connector box 40 must either be left handed, or specially tightened and spot welded together. This is necessary so that this joint does not unscrew during operation.

Figure 6:
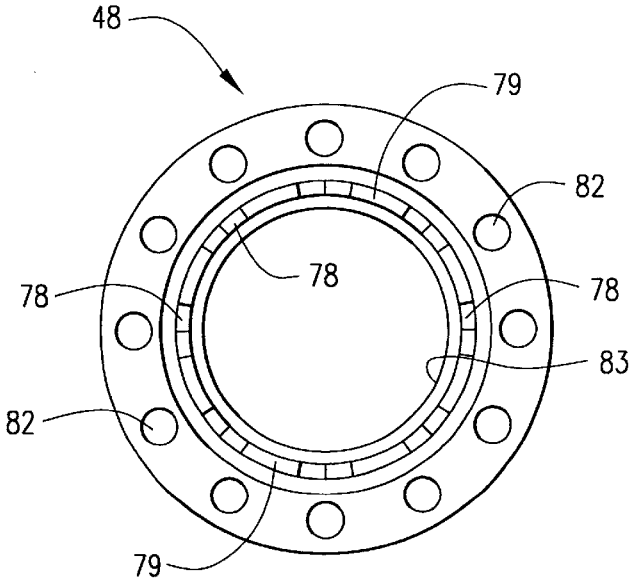
FIG. 6A is a partial cross-section elevational view of a stator connector box of the electric submersible pump assembly of FIG. 1.
FIG. 6B is the projected end view of the stator connector box of the electric submersible pump assembly of FIG. 1.

FIG. 6A shows the stator connector box 48 that has a device body 76, an upper end portion 77, easy-catch internal hex spline members 78, grooves 79, external tubing threads 80, a lower end portion 81 and fastener openings 82. The easy-catch internal hex spline members 78, that are engaging members, can be a locking means as well as a locating means. The device body 76 of the stator connector box 48 defines a central cavity 83 concentric thereto on the longitudinal axis of the stator connector box 48. The fastener openings 82 are spatially disposed to accept the fasteners 85 to attach the stator connector box 48 to the housing of the motor service section 14 (FIG. 2).

FIG. 6B shows a projected end view of the stator connector box 48 with fastener openings 82, internal spline members 78 and internal grooves 79. The spline members 64 and grooves 66 of the stator connector pin 38 engage with the internal spline members 78 and grooves 79 of the stator connector box 48 such that when engaged, the longitudinal axis of the stator connector pin 38 is coincident with the longitudinal axis of the stator connector box 48.

Figure 7:
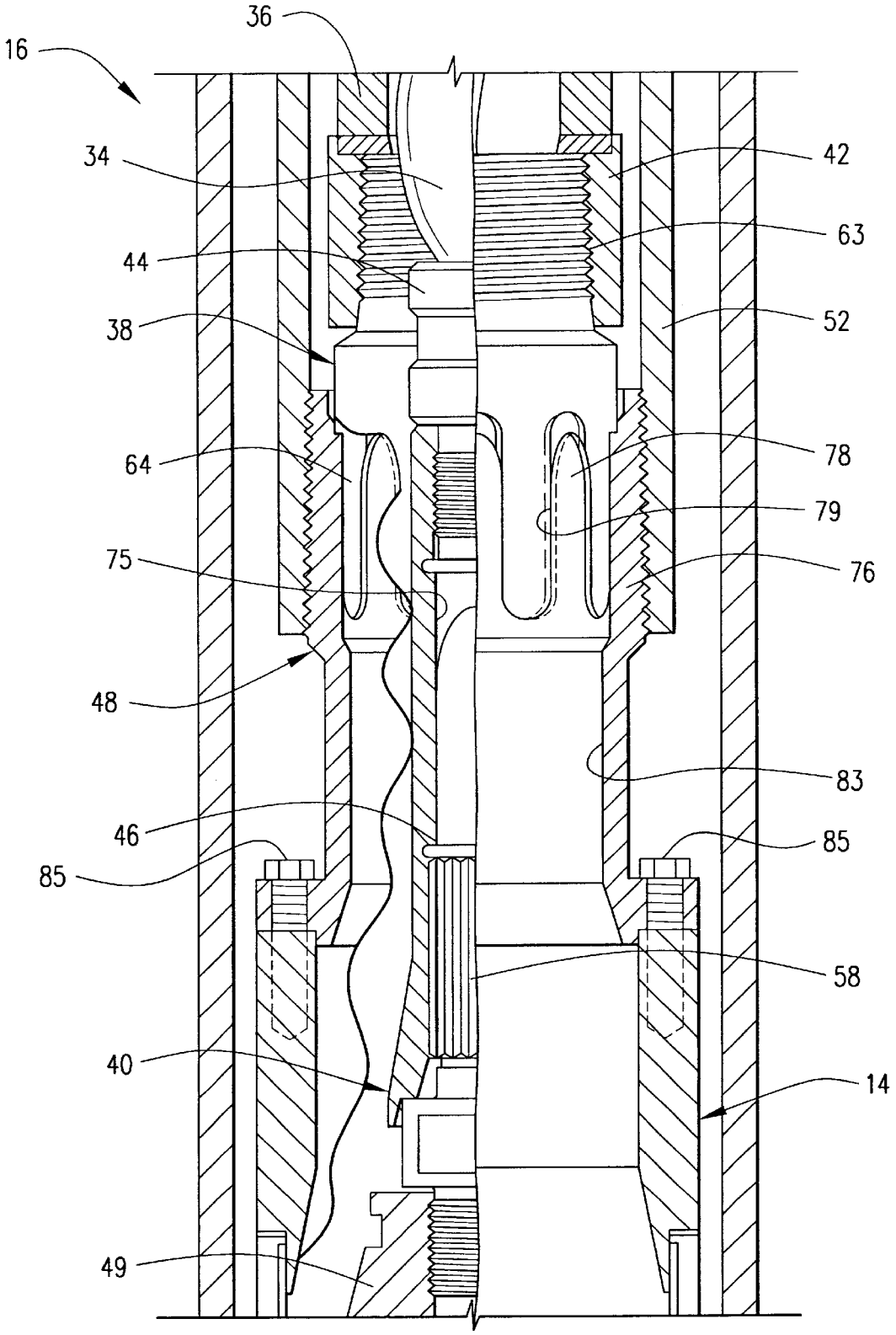
FIG. 7 is a partially cutaway, cross-sectional, elevational view of the assembled and coupled latch device of FIG. 2.

FIG. 7 shows the assembled and coupled latch device 16. As discussed above, the stator connector box 48 is attached to the housing of the motor service section 14 with the fasteners 85 and the rotor connector pin 46 screwed onto the motor shaft 49 of the motor service section 14. Also the rotor connector box 40 is connected onto the pump rotor 34 with the rotor coupling 44, and the stator connector pin 38 is secured to the stator 36 by being screwed into the stator coupling 42.

In FIG. 7, the assembled latch device 16 is shown coupled having one common longitudinal axis. The rotor connector pin 46 is coupled in the central cavity 75 of the rotor connector box 40 such that the external involute spline members 58 of the rotor connector pin 46 have interlocated with the internal involute spline members 68 of the rotor connector box 40. Also the spline members 64 of the stator connector pin 38 are located in the internal grooves 79 of the stator connector box 48.

The assembled and coupled latch device 16 has a stationary assembly including the stator coupling 42, stator connector pin 38, stator connector box 48, which with the stator 36 and the housing of the motor service section 14, provide the engaged, stationary portion of the electric submersible pump assembly 10 (FIG. 1). The assembled and coupled latch device 16 also includes the rotor coupling 44, rotor connector box 40, rotor connector pin 46, which with the pump rotor 34 and motor shaft 49, provides the engaged rotating portion of the electric submersible pump assembly 10 that can freely rotate within the assembled and coupled stationary portion.

In the present invention, the externally threaded stator connector box 48 is connected into motor tubing 52, which can be 4½ inch tubing for example, used to locate the motor assembly 12, motor service section 14 and motor latch assembly 32 in the wellbore 24 near the production zone 28. The pump 18 and pump latch connector 30 are shown placed in the tubing used to locate the motor assembly 12 and shown coupled with motor latch connector 32.

As shown in FIG. 1, the motor assembly 12, including the motor latch connector 32, is placed in the wellbore 24 on the motor tubing 52 having the flat cable 54 attached but without the pump 18 attached. The motor assembly 12 and motor latch connector 32 are landed and the cable 54 is connected to a switchboard or variable speed controller 86.

The pump 18, for example a progressive cavity or centrifugal pump, with the pump latch connector 30 is lowered on coiled tubing or other suitable tubing, such as 2½ coil tubing or 2½ production tubing 20 for example, into the previously installed motor tubing 52. As the pump 18 is lowered into the well, the guide pin 56 (FIG. 2) of the rotor connector pin 46 first contacts the guide-shoe 70 of the rotor connector box 40. The guide pin 56 of the rotor connector pin 46 guides the rotor connector pin 46 into the rotor connector box 40 until the lower end portion 62 of the stator connector pin 38 contacts the upper end portion 77 of the stator connector box 48. The male easy-catch, hex spline members 64 and grooves 66 of the stator connector pin 38 will interconnect with the internal hex spline members 78 and internal grooves 79 of the stator connector box 48, thus helping to guide the rotor connector pin 46 into the rotor connector box 40.

Finally, the external spline member 58 on the rotor connector pin 46 will interconnect with the involute female spline member 68 of the rotor connector box 40, thereby allowing torque transfer through the rotor connector pin 46 and rotor connector box 40. The well is then prepared for operation as one skilled in the art would currently prepare the well for production. It should be noted that the upper end portion 77 of the stator connector box 48 and the lower end portion 62 of the stator connector pin 38 cooperate to serve as sturdy guides, protecting the more closely spaced spline member 58 and spline member 68; these also serve as a stop to protect the spline members 58, 68 from being over run.

Once the production tubing 20 is in place and the motor cable 54 is connected to a switchboard or variable speed converter 86, the pump 18 can then be energized by the motor 22 as required to operate the pump 18.

An alternative procedure for setting the motor assembly 12 is to attach the motor tubing 52 with the motor assembly and the motor connector latch via a tubing collar (not shown) and locate the motor assembly 12 in the wellbore. The motor tubing 52 can be released if another device, such as a packer, is being used to hold the motor assembly 12 in place, or the motor tubing 52 can stay attached to the motor assembly 12 as described herein and hung from the packer 21 (FIG. 1). The motor tubing 52 can also be hung from the surface 26 as described above.

Referring to FIG. 1, a production stream 92 enters the wellbore 24 from the production zone 28 and flows to the electric submersible pump assembly 10. The motor-powered pump 18 such as a progressive cavity which is well suited to this invention, is energized and the production stream 92 is drawn into the pump 18 and pumped thereby through the production tubing 20 to the surface 26. If significant gas is present in the fluid stream, it can be advantageous to use a gas separator-type pump intake or other known methods to handle the gas expansion.

In the event that the pump 18 fails, or for some other reason must be replaced, the motor 22 is de-energized and the pump 18 and the pump latch connector 30 are released from the motor latch connector 32 by lifting the production tubing 20, or other release technique well known in the art. Once release is achieved, the production tubing 20, the pump 18 and the pump latch connector 30 are pulled out of the wellbore 24. This allows such pump repairs as may be necessary to be completed and the pump 18 can then be placed back in the wellbore 24. This is especially helpful at remote locations in conjunction with a coil tubing unit, such as in offshore wells drilled from a drilling platform that is no longer on location. The coil tubing can be used for the production tubing 20 and the pump 18 pulled by the coil tubing unit. The current invention is well adapted to many types of pumps, as one skilled in the art would be aware, such as the progressive cavity pump or centrifugal pumps mentioned above or other types of pumps that well known in the industry.

When the pump 18 is ready to be located back into the wellbore 24, the pump 18 and attached pump latch connector 30 are placed in therein such as with coil tubing to couple with the motor assembly 12 and motor latch connector 32 that remained in the wellbore 24.

If the motor 22 is to be pulled out of the wellbore 24, the packer 21 and any other device holding the motor assembly 12 in the wellbore 24 must be released. The motor assembly 12 can be pulled after the pump 18 was removed.

It is clear that the present invention is well adapted to carry out the objects and to attain the ends and advantages mentioned as well as those inherent therein. While presently preferred embodiments of the invention have been described in varying detail for purposes of the disclosure, it will be understood that numerous changes can be made which will readily suggest themselves to those skilled in the art and which are encompassed within the spirit of the invention disclosed and as defined in the above text and in the accompanying drawings.

What is claimed is:

1. An electric submersible pump assembly disposable in a wellbore, comprising:

a motor having a motor shaft;

a pump energized in response to the motor shaft, comprising:
- a pump stator; and
- a pump rotor rotated by the motor shaft; and a latch device disposed between the motor shaft and the pump rotor, comprising:
- a pump latch connector connected to the pump comprising:
  - a rotor connector box attached to the pump rotor; and
  - a stator connector pin attached to the pump stator; and
- a motor latch connector connected to the motor, comprising:
  - a stator connector box interconnected to the stator connector pin; and
  - a rotor connector pin disposable in the rotor connector box such that the motor shaft transfers torque to the rotor.

2. An electric submersible pump assembly disposable in a wellbore, comprising:

a motor assembly comprising:
- a motor service section housing; and
- a motor, including a motor shaft disposed in the motor service section housing;

a pump energized in response to the motor, comprising:
- a pump stator;
- a pump rotor with a lower end portion disposed in the pump stator; and
- a rotor coupling attached to the lower end portion of the pump rotor; and a latch device disposed between the motor assembly and the pump, comprising:
- a rotor connector box comprising:
  - a device body, with an engaging member, having an upper end portion, a lower end portion, and defining a central cavity;
- a rotor connector pin attached to the motor shaft, comprising
  - a device body, with an engaging member, having an upper end portion and a lower end portion, wherein the device body is disposable in the rotor connector box central cavity.

3. The electric submersible pump assembly of claim 2, the rotor connector pin further comprising:

a guide pin proximate the upper end portion of the rotor connector box device body disposable in the rotor connector box central cavity; and a threaded means on the lower end portion of the rotor connector pin device body for connecting the rotor connector pin to the motor shaft such that the motor shaft is capable of torque transfer to the pump rotor.

4. The electric submersible pump assembly of claim 3, the rotor connector box further comprising:

a threaded means on the upper end portion of the rotor connector box device body for connecting the rotor connector box to the rotor coupling; and a guide shoe proximate to the lower end portion of the rotor connector box device body.

5. The electric submersible pump assembly of claim 4, the latch device further comprising:

a stator connector pin attached to the pump stator, the stator connector pin comprising a device body, with an engaging member, having an upper end portion, a lower end portion, and defining a central cavity.

6. The electric submersible pump assembly of claim 5, the latch device further comprising:

a stator connector box attached to the motor service section housing, the stator connector box comprising a device body, with an engaging member, having an upper end portion, a lower end portion, and defining a central cavity wherein the upper end portion interconnects with the stator connector pin.

7. The electric submersible pump assembly of claim 6, the stator connector pin further comprising:

a threaded means on the upper end portion of the device body for connecting the stator connector pin to the pump stator; and a guide means on the lower end portion of the device body.

8. The electric submersible pump assembly of claim 7, the stator connector box further comprising:

a guide means proximate to the upper end portion of the device body interconnected with the stator connector pin; and a connector means proximate to the upper end portion of the device body for connecting the stator connector box to the motor assembly.

9. An electric submersible pump assembly disposable in a wellbore, comprising:

a motor assembly comprising:
- a motor service section housing; and
- a motor, including a motor shaft disposed in the motor service section housing;

a pump that is energized in response to the motor, comprising:
- a pump stator;
- a pump rotor with a lower end portion, disposed in the pump stator; and
- a rotor coupling that is attached to the lower end portion of the pump rotor;

a pump latch connector connected to the pump comprising:
- a rotor connector box comprising:
  - a device body having an upper end portion, a lower end portion, and defining a central cavity;
  - a threaded means within the central cavity of the upper end portion of the device body for connecting the rotor connector box to the pump rotor;
  - a guide means within the central cavity of the lower end portion of the device body; and
  - a guide shoe within the central cavity of the lower end portion of the device body proximate to the guide means; and
- a stator connector pin comprising:
  - a device body having an upper end portion, a lower end portion, and defining a central cavity;
  - a threaded means on the upper end portion of the device body for connecting the stator connector pin to the pump stator; and
  - a guide means on the lower end portion of the device body; and a motor latch connector connected to the motor comprising:
- a stator connector box comprising:
  - a device body having an upper end portion, a lower end portion, and defining a central cavity;
  - a guide means within the central cavity of the upper end portion of the device body for interconnecting with the guide means of the stator connector pin;
  - a connector means on the upper end of the device body for connecting the stator connector box to the motor; and
- a rotor connector pin comprising:
  - a guide pin disposable in the central cavity of the rotor connector box;
  - a base;
  - a guide means on the guide pin proximate the base for guiding the rotor connector pin into the guide means of the rotor connector box; and
  - a threaded means proximate to the base for connecting the rotor connector pin to the motor shaft such that the motor shaft is capable of torque transfer to the pump rotor.

10. A latch device for use with an electric submersible pump assembly disposed between a motor assembly and a pump, comprising:

a rotor connector box comprising:
- a device body, with an engaging member, having an upper end portion, a lower end portion, and defining a central cavity; and a rotor connector pin attached to the motor shaft, comprising
- a device body, with an engaging member, having an upper end portion and a lower end portion, wherein the device body is disposable in the rotor connector box central cavity.

11. The latch device of claim 10, the rotor connector pin further comprising:

a guide pin proximate the upper end portion of the rotor connector box device body disposable in the rotor connector box central cavity; and a threaded means on the lower end portion of the rotor connector pin device body for connecting the rotor connector pin to the motor shaft such that the motor shaft is capable of torque transfer to the pump rotor.

12. The latch device of claim 11, the rotor connector box further comprising:

a threaded means on the upper end portion of the rotor connector box device body for connecting the rotor connector box to the rotor coupling; and a guide shoe proximate to the lower end portion of the rotor connector box device body.

13. The latch device of claim 12 further comprising:

a stator connector pin attached to the pump stator, the stator connector pin comprising a device body having an upper end portion, a lower end portion, and defining a central cavity.

14. The latch device of claim 13 further comprising:

a stator connector box attached to the motor service section housing, the stator connector box comprising a device body, having an upper end portion, a lower end portion, and defining a central cavity, wherein the upper end portion interconnects with the stator connector pin.

15. The latch device of claim 14, the stator connector pin further comprising:

a threaded means on the upper end portion of the device body for connecting the stator connector pin to the pump stator; and a guide means on the lower end portion of the device body.

16. The latch device of claim 15, the stator connector box further comprising:

a guide means proximate to the upper end portion of the device body interconnected with the stator connector pin; and a connector means proximate to the upper end portion of the device body for connecting the stator connector box to the motor assembly.

17. A method for locating an electric submersible pump assembly with a motor, a pump, and an latch device, including a pump latch connector and a motor latch connector, for use in a wellbore to pressurize a production stream for production at a surface, the method comprising:

locating the motor and the motor latch connector in the wellbore;

disposing the pump and the pump latch connector in the wellbore such that it interconnects with the motor latch connector;

powering the motor to facilitate rotation of the motor;

transferring torque from the motor to the pump through the motor latch connector and the pump latch connector to allow the production stream to pass through the pump in the electric submersible pump assembly; and pressurizing the production stream to facilitate the movement of the production stream to the surface.

18. An electric submersible pump assembly disposable in a wellbore, comprising:

a motor assembly comprising:

a motor service section housing; and a motor, including a motor shaft disposed in the motor service section housing;

a pump energized in response to the motor, comprising:

a pump stator;

a pump rotor with a lower end portion disposed in the pump stator; and a rotor coupling attached to the lower end portion of the pump rotor; and a latch device disposed between the motor assembly and the pump, comprising:

a pump latch connector connected to the pump comprising:

a rotor connector box comprising:

a device body having an upper end portion, a lower end portion, and defining a central cavity;

a threaded means within the central cavity of the upper end portion of the device body for connecting the rotor connector box to the pump rotor;

a guide means within the central cavity of the lower end portion of the device body; and a guide shoe within the central cavity of the lower end portion of the device body proximate to the guide means; and a stator connector pin comprising:

a device body having an upper end portion, a lower end portion, and defining a central cavity;

a threaded means on the upper end portion of the device body for connecting the stator connector pin to the pump stator; and a guide means on the lower end portion of the device body; and a motor latch connector connected to the motor comprising:

a stator connector box comprising:

a device body having an upper end portion, a lower end portion, and defining a central cavity;

a guide means within the central cavity of the upper end portion of the device body for interconnecting with the guide means of the stator connector pin; and a connector means on the upper of the device body for connecting the stator connector box to the motor; and a rotor connector pin comprising:

a guide pin disposable in the central cavity of the rotor connector box;

a base;

a guide means on the guide pin proximate the base for guiding the rotor connector pin into the guide means of the rotor connector box; and a threaded means proximate to the base for connecting the rotor connector pin to the motor shaft such that the motor shaft is capable of torque transfer to the pump rotor.

* * * * *

UNITED STATES PATENT AND TRADEMARK OFFICE

CERTIFICATE OF CORRECTION

PATENT NO. : 6,561,775 B1
DATED : May 13, 2003
INVENTOR(S) : Hans Wefers

It is certified that error appears in the above-identified patent and that said Letters Patent is hereby corrected as shown below:

Column 4,
Lines 56 and 57, replace "such as 2 1/2 coil tubing or 2 1/2 production tubing" with -- such as 2 1/2" coil tubing or 2 1/2" production tubing --

Column 5,
Line 61, replace "are placed in therein" with -- are placed therein --

Signed and Sealed this

Twentieth Day of January, 2004

JON W. DUDAS
*Acting Director of the United States Patent and Trademark Office*